United States Patent [19]

Komossa et al.

[11] 4,364,402

[45] Dec. 21, 1982

[54] APPARATUS FOR AUTOMATIC COMPENSATION OF WEAR UPON ORBITING KNIVES IN TOBACCO CUTTING MACHINES OR THE LIKE

[75] Inventors: Werner Komossa, Börnsen; Uwe Elsner, Dassendorf, both of Fed. Rep. of Germany

[73] Assignee: Hauni-Werke Körber & Co. KG, Hamburg, Fed. Rep. of Germany

[21] Appl. No.: 149,975

[22] Filed: May 15, 1980

[30] Foreign Application Priority Data

May 29, 1979 [DE] Fed. Rep. of Germany ..... 2921665

[51] Int. Cl.[3] ..... A24C 7/04; A24C 3/07; A24C 7/12; A24C 7/14

[52] U.S. Cl. ..... 131/311; 131/117; 131/118; 83/62; 83/699; 83/700; 83/677

[58] Field of Search ..... 131/145, 311, 117, 118; 83/62, 699, 700, 677

[56] References Cited

U.S. PATENT DOCUMENTS 4,056,022 11/1977 Ray ..... 83/677

*Primary Examiner*—V. Millin

*Attorney, Agent, or Firm*—Kontler, Grimes & Battersby

[57] ABSTRACT

Apparatus for moving the knives relative to their rotary holder in a tobacco cutting machine has a crankshaft which is rotatable and is rotated once during several successive revolutions of the holder. The crankshaft is the input element of a step-down transmission whose output element is a ring gear meshing with pinions for transmission of motion to discrete displacing units, one for each knife. The ring gear is rotated at intervals by a gear which is coaxial with a freewheel. The latter is rocked back and forth by a lever which is pivoted by the crank pin of the crankshaft by way of a rod-like connector. One end portion of the connector is coupled to the lever by an adjusting device which can change the extent of pivotal movement of the lever and hence the extent of rotation of the ring gear whenever the lever is pivoted in one of two directions.

12 Claims, 5 Drawing Figures

APPARATUS FOR AUTOMATIC COMPENSATION OF WEAR UPON ORBITING KNIVES IN TOBACCO CUTTING MACHINES OR THE LIKE

BACKGROUND OF THE INVENTION

The present invention relates to apparatus for moving one or more knives relative to their holder, and more particularly to improvements in apparatus for automatic compensation of wear upon knives which orbit about the axis of a rotary knife holder and serve for comminution of tobacco leaves, tobacco ribs or the like. Still more particularly, the invention relates to apparatus for automatic advancement of the cutting edges of knives, especially beyond the periphery of a rotary cylindrical or polygonal holder which rotates about a fixed axis in a tobacco shredding or like machine.

It is well known to provide the knife holder in a tobacco cutting machine with means for automatically advancing the knives relative to the holder as well as with means for automatically grinding or sharpening the cutting edges of the knives when the machine is in use. Continuous or frequent advancement of the knives is desirable and normally necessary because the knives are subjected to pronounced wear, not only because a modern cutting machine turns out large quantities of shreds or otherwise configurated tobacco particles per unit of time but also because, in spite of thorough cleaning, tobacco leaves which enter a shredder still carry reasonably large quantities of sand. This contributes to rapid dulling of the cutting edges. In order to maintain the cutting edges in proper condition for satisfactory severing, the knives are normally sharpened during each revolution of their holder with attendant additional wear upon the material of the knives. Other factors which influence the wear upon the cutting edges of the knives include changeover from treatment of one type of tobacco to treatment of other tobacco types, varying quantities of sand and/or other foreign matter in the material to be comminuted, changeover from the making of relatively thin shreds to the making of larger fragments, the percentage of stem, ribs and birds' eyes in the material to be comminuted, fluctuations in the quality of tobacco in a batch which is being fed into the cutting machine and/or others. It is desirable to equip the machine with means which renders to possible to advance or feed the knives relative to their holder at a rate which is selected by full consideration of at least some of the above outlined factors to thus ensure that the quality of the comminuted material will meet the specifications of manufacturers of cigarettes or other smokers' products containing shreds or otherwise configurated particles of natural or reconstituted tobacco and/or tobacco substitutes. In accordance with the presently prevailing practice, the knives receive motion from a transmission, certain constituents of which must be replaced whenever an operator desires to change the extent to which the knives are shifted or otherwise displaced relative to their holder. This is a time-consuming operation which invariably entails prolonged interruptions of operation with attendant losses in output of the cutting machine. Such losses are especially undesirable if the cutting machine forms part of a complete production line wherein tobacco leaves are conditioned, severed and/or otherwise treated prior to introduction of comminuted tobacco into the magazine or magazines of one or more cigarette makers or the like.

OBJECTS AND SUMMARY OF THE INVENTION

An object of the invention is to provide a machine for the cutting of tobacco or the like with a novel and improved apparatus for moving one or more knives relative to their rotary holder with a high degree of precision and uniformity.

Another object of the invention is to provide the apparatus with novel and improved means for rapidly and accurately changing the extent of movement of one or more knives with reference to their holder.

A further object of the invention is to provide an apparatus which occupies little room, which can be installed in existing tobacco shredding or like machines, and which requires a minimum of attention when the machine is in use.

An additional object of the invention is to provide a novel an improved step-down transmission between the device or devices which rotate the knife holder (or between the knife holder) and the means for moving the knives relative to their holder.

An ancillary object of the invention is to provide novel and improved means for transmitting motion from the input means to the output means of the aforementioned transmission.

Another object of the invention is to provide novel and improved means for driving the input means of the transmission.

A further object of the invention is to provide novel and improved means for driving the mechanism or mechanisms which shifts or shift the knife or knives with respect to the holder in response to movement of output means of the transmission.

An additional object of the invention is to provide novel and improved means for changing the extent of movement of output means of the transmission.

The invention is embodied in an apparatus which compensates for wear upon at least one knife which is mounted on or in and is movable with respect to a rotary holder, particularly in an apparatus which can move several knives with reference to their holder in a tobacco cutting machine (such as a machine which shreds tobacco leaf laminae). The apparatus comprises a transmission (preferably a step-down transmission) which is mounted on or in and has input means receiving motion in response to rotation of the holder, movable output means, and motion transmitting means for intermittently moving the output means in response to movement of the input means. The apparatus further comprises displacing means which moves the knife or knives with reference to the holder in response to intermittent movements of the output means.

In accordance with a presently preferred embodiment of the invention, the input means comprises a rotary crankshaft and the output means comprises a rotary element (e.g., a spur gear, a pinion or a ring gear). In such apparatus, the motion transmitting means of the transmission can comprise a pivotable member (e.g., a one-armed lever) which is pivotable in the holder about a predetermined axis, a connector (such as a rod) or other suitable means for pivoting the lever in first and second directions in response to rotation of the crankshaft, and means for driving the rotary element in response to pivoting of the lever in the first direction. Such driving means can comprise a freewheel or another suitable one-way clutch.

In accordance with another feature of the invention, the apparatus further comprises adjusting means which serves to vary the extent of pivotal movement of the lever in the first and second directions in response to rotation of the crankshaft to thereby change the extent of intermittent movement of the knife or knives relative to the holder. The adjusting means can comprise means for varying the effective length of the lever, e.g., for coupling the connector with the lever at any one of a plurality of different distances from the axis of the lever.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
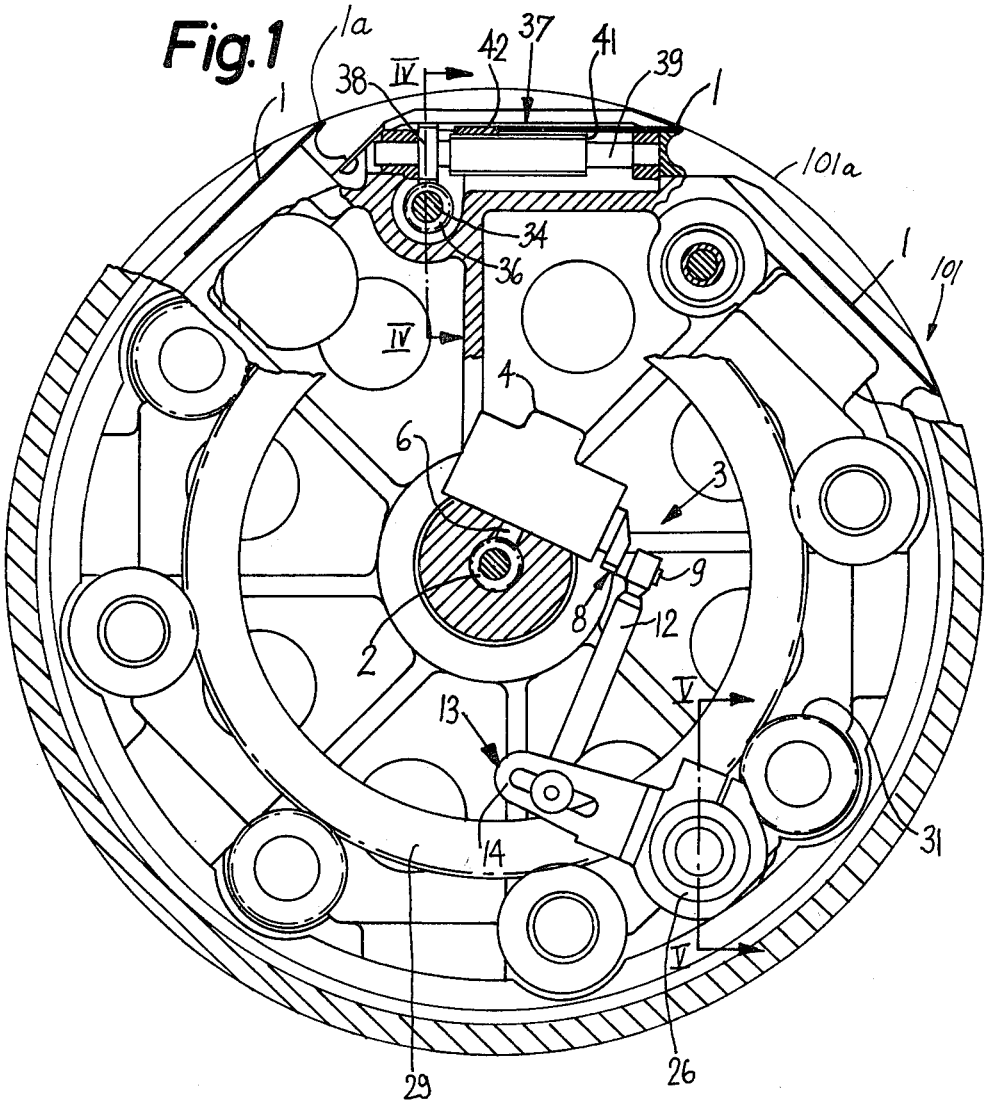
FIG. 1 is a transverse sectional view of a rotary holder for knives in a tobacco cutting machine wherein the knives are advanced by an apparatus which embodies one form of the invention, certain portions of the holder and of the apparatus being broken away for the sake of clarity.

FIG. 1 shows a drum-shaped rotary holder 101 for several equidistant knives or cutters 1 whose cutting edges 1*a* extend slightly beyond the peripheral surface 101*a* of the holder 101. The holder 101 is installed in a cigarette cutting or comminuting machine, e.g., in a machine shown in FIG. 1 of commonly owned U.S. Pat. No. 4,090,521 granted May 23, 1978 to Uwe Elsner. The just mentioned patent also describes and shows means for rotating the holder as well as means for sharpening the cutting edges of the orbiting knives. For the sake of convenience, the disclosure of the patent to Elsner is incorporated herein by reference. The tobacco comminuting machine which is described in the patent to Elsner is of the type known as KT produced and sold by the assignee of the present application.

Figures 2, 3:
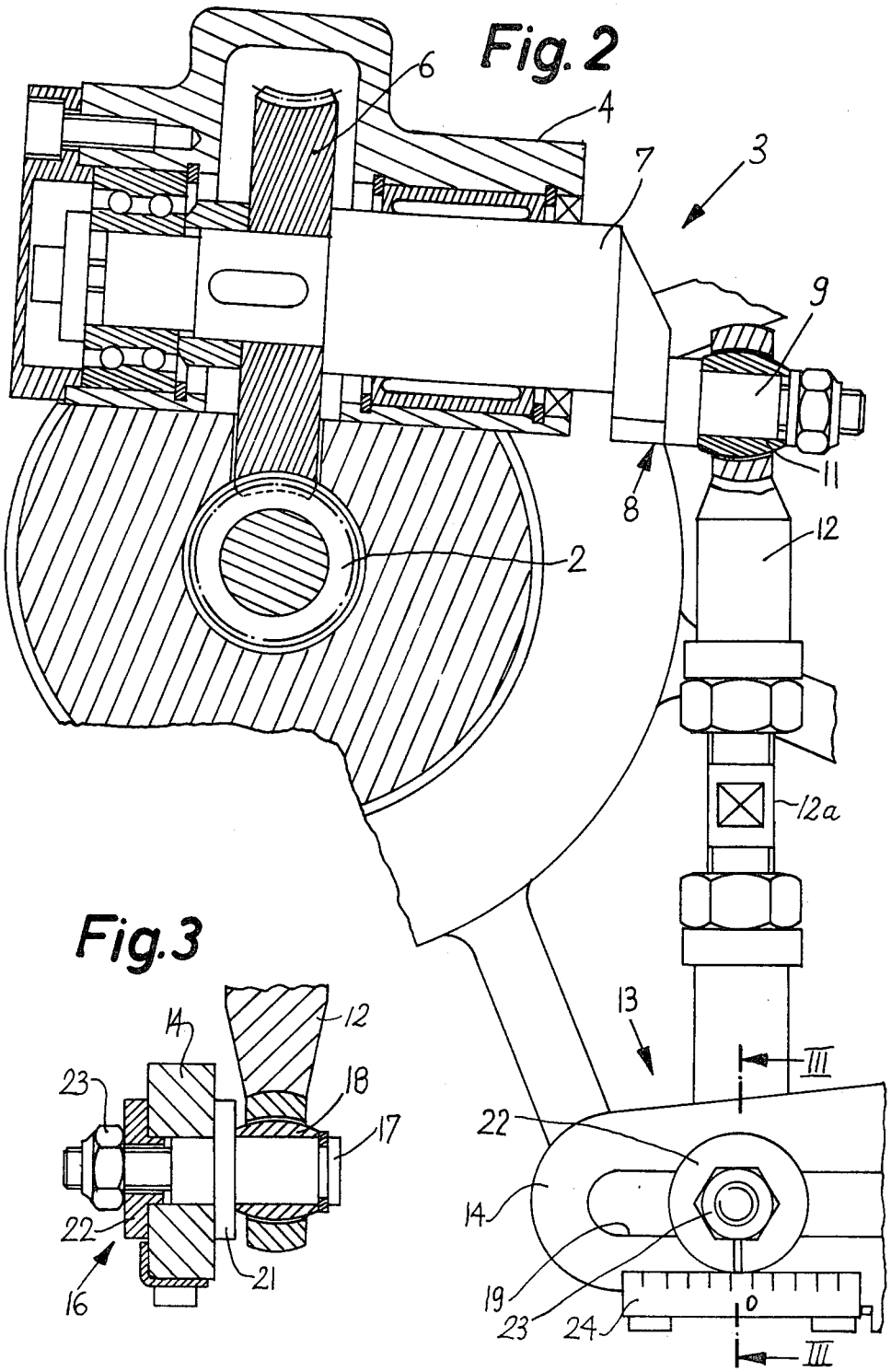
FIG. 2 is an enlarged view of a detail of the apparatus of FIG. 1, with the gear case of the transmission shown in section.
FIG. 3 is a sectional view as seen in the direction of arrows from the line III—III of FIG. 2.

The drum-shaped knife holder 101 can be driven to rotate about the axis of a stationary worm 2 which automatically transmits torque to the rotary input means 7 of a step-down transmission 3 mounted in and/or on the holder 101. The arrangement is such that a crankshaft 8 of the input means 7 rotates in automatic response to rotation of the holder 101 about its axis, i.e., in response to rotation of the holder 101 about the axis of the worm 2. The transmission 3 comprises a housing or gear case 4 for the crankshaft 8 of the input means 7. The crankshaft 8 rotates in response to rotation of the holder 101 because it is coaxial with and is rigidly connected to a worm wheel 6 which mates with the worm 2 and is arranged to perform one full revolution about the axis of the crankshaft 8 in response to several (e.g., fifty) revolutions of the holder 101 about the axis of the worm 2. As shown in FIG. 2, a portion of the worm wheel 6 extends from the gear case 4 and radially toward the common axis of the worm 2 and holder 101. That end portion of the crankshaft 8 which extends from the gear case 4 has an eccentric crank pin 9 which is articulately connected with one end portion of an elongated rod-like connector 12 by a univeral joint 11 (e.g., a spherical bearing). The effective length of the connector 12 is adjustable, as at 12*a*.

The output means of the step-down transmission 3 is or comprises a rotary element 29 here shown as a ring gear which is coaxial with the holder 101 and is rotatable therein or thereon in a single direction. The aforementioned connector 12 constitutes one component of a motion transmitting unit which forms a part of the transmission 3 and serves to intermittently rotate the ring gear 29 in response to rotation of the crankshaft 8 of the input means 7. The motion transmitting unit of the transmission 3 further comprises a drive 13 including a pivotable member or lever 14 which is movable back and forth (i.e., in first and second directions) about an axis defined by the holder 101 and orbiting about the axis of the stationary worm 2 when the holder 101 rotates. Still further, the motion transmitting means comprises a freewheel or one-way clutch 26 which is interposed between the lever 14 and the ring gear 29 to rotate the latter when the lever 14 is pivoted in a first direction but not when the lever is caused to pivot in a second direction opposite the first direction.

The apparatus of the present invention further comprises adjusting means 16 for varying the extent of pivotal movement of the lever 14 in response to rotation of the crankshaft 8 of the input means 7. In other words, the adjusting means serves to vary the effective length of the lever 14, namely, the distance between the pivot axis of the lever and the locus where the lever is coupled to the other end portion of the elongated connector 12 by the adjusting means 16.

The lever 14 has an elongated slot 19 which extends radially of its axis and receives a pin 17 of the adjusting means 16. The pin 17 couples the respective end portion of the connector 12 to the lever 14, again by way of a universal joint here shown as a spherical bearing 18 (see FIG. 3). The means for releasably locking the pin 17 at a selected distance from the pivot axis of the lever 14 comprises a clamping disc or washer 22 which is slipped onto the pin 17 and is caused to bear against one side of the lever 14 in response to tightening of a lock nut 23. The pin 17 further carries a collar 21 which bears against the other side of the lever 14 (see FIG. 3). In order to facilitate rapid adjustment of the distance between the axis of the lever 14 and the axis of the pin 17, the lever 14 carries a scale 24 with graduations extending to both sides of a zero point. When the lock nut 23 is loosened and the pin 17 is shifted in a direction to the left, as viewed in FIG. 2, so that its axis registers with a negative graduation on the scale 24, the strokes of the lever 14 are reduced to thereby reduce the extent of angular movement of the ring gear 29 in response to each pivotal movement of the lever 14 in the first direction. The strokes of the lever 14 are increased if the pin 17 is shifted in the slot 19 in a direction to the right, as viewed in FIG. 2, i.e., into register with a selected graduation in the plus region of the scale 24.

Figure 4:
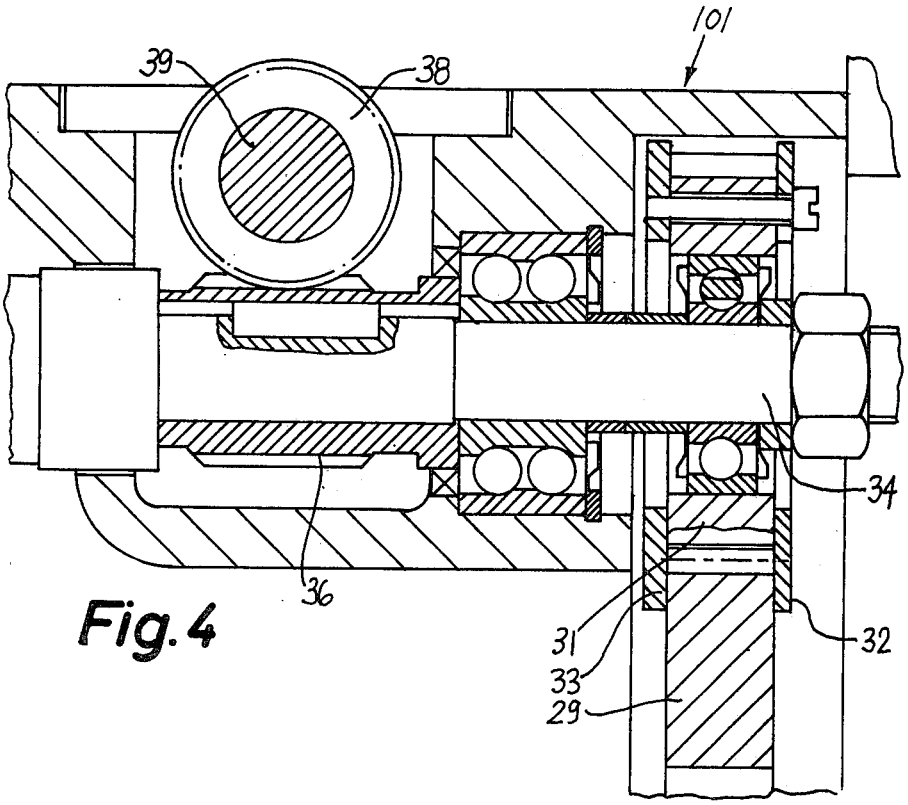
FIG. 4 is an enlarged sectional view as seen in the direction of arrows from the line IV—IV of FIG. 1.
Figure 5:
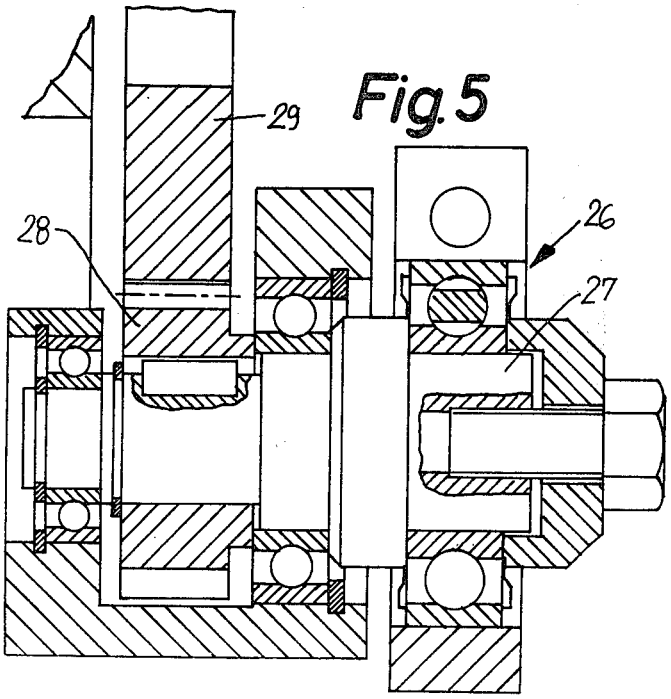
FIG. 5 is an enlarged sectional view as seen in the direction of arrows from the line V—V of FIG. 1.

The shaft 27 (see FIG. 5) of the freewheel 26 is rotatably journalled in the holder 101 and is coaxially secured to a gear 28 which meshes with and rotates the ring gear 29 when the lever 14 is pivoted in the first direction. The ring gear 29 can transmit motion to all of the knives 1 through the medium of several discrete displacing means which are operative to move the cutting edges of the knives 1 outwardly, i.e., beyond the peripheral surface 101*a* of the holder 101 when the ring gear 29 is driven by the gear 28. Each displacing means comprises a discrete pinion 31 which meshes with the ring gear 29. The pinions 31 serve as means for rotatably supporting the ring gear 29 in or on the holder 101. Each second pinion 31 is flanked by two washers 32, 33 (see FIG. 4) which hold the ring gear 29 against axial movement with reference to the holder 101. The pinions 31 are mounted on discrete shafts 34 (e.g., by means of one-way clutches) which are rotatable in the holder 101 and transmit motion to the respective knives 1 in a manner as shown in FIGS. 1 and 4. To this end, each shaft 34 carries a worm 36 which serves to impart motion to the means 37 for directly shifting or moving the respective knife 1. Each shifting means 37 comprises a worm wheel 38 which meshes with the corresponding worm 36 and is fixed to a shaft 39 The latter is provided with or connected to a feed screw 41 which meshes with a nut 42 (e.g., a nut which extends along an arc of approximately 180 degrees) secured to the respective knife 1. It goes without saying that the improved apparatus can be provided with several shifting means 37 for each knife 1. This is especially desirable when the axial length of the holder 101 is considerable, i.e., when the distance between the two end faces of this holder (and hence the length of the cutting edges 1*a* of the knives 1) is quite pronounced. In such instances, it is desirable to provide discrete first and second shifting means for each knife 1, one at each axial end of the holder 101, so that the cooperating shifting means for any given knife 1 are mirror symmetrical to each other with reference to a plane which is normal to the axis of the worm 2 and is disposed midway between the axial ends of the holder 101.

The operation is as follows:

FIG. 1 shows the crank pin 9 of the crankshaft 8 in one end position at a minimum distance from the freewheel 26. After approximately twenty-five revolutions of the holder 101, the crankshaft 8 completes one half revolution about its axis and moves the crank pin 9 to a position at a maximum distance from the freewheel 26. During such gradual angular movement of the crankshaft 8 through 180 degrees, the lever 14 is pivoted in first direction (clockwise, as viewed in FIG. 1) whereby the angular position of the ring gear 29 remains unchanged because the freewheel 26 cannot rotate the shaft 27 when the lever 14 pivots clockwise. As explained hereinabove, the crankshaft 8 rotates in response to rotation of the holder 101, i.e., in response to orbital movement of the worm wheel 6 about the axis of the stationary worm 2.

The freewheel 26 begins to turn the ring gear 29 via gear 28 and shaft 27 when the lever 14 is pivoted in a counterclockwise direction, as viewed in FIG. 1, i.e., when the crank pin 9 moves back toward the position of FIG. 1. The ring gear 29 rotates the pinions 31 which drive the respective shafts 34 and hence the respective shifting means 37 to advance the cutting edges 1*a* of all knives 1 outwardly and to the same extent. It will be noted that each worm 36 rotates the respective worm wheel 38 only during approximately one-half of each revolution of the crankshaft 8, i.e., in response to certain revolutions of the holder 101.

If the extent to which the knives 1 should move outwardly is to be reduced, the lock nut 23 is loosened and the pin 17 is shifted in the slot 19 of the lever 14 in a direction to increase the distance between the axes of the pin 17 and freewheel 26. The lock nut 23 is then tightened again and the apparatus is ready for use. If the extent of outward movement of the knives 1 in response to a certain number of revolutions of the holder 101 is to be reduced, the lock nut 23 is loosened again and the pin 17 is shifted in a direction toward the axis of the lever 14., i.e., in a direction to reduce the effective length of the lever.

An important advantage of the improved apparatus is that the adjusting means 16 allows for highly accurate selection of the extent of intermittent movement or shifting of all knives 1 with reference to the holder 101. Also, the adjusting means 16 can be actuated and its lock nut 23 tightened again within a short interval of time so that the periods of idleness of the tobacco cutting machine for the purpose of adjusting the extent of displacement of the knives 1 are surprisingly short. The extent of outward movement of the knives 1 can be increased or reduced, and the operator is in a position to return the pin 17 to any selected position with reference to the freewheel 26 as often as desired.

It is also within the scope of the invention to replace the adjusting means 16 with a different adjusting means, e.g., with a means for adjusting the eccentricity of the crank pin 9 with reference to the axis of the worm wheel 6. The illustrated adjusting means 16 is preferred at this time because it is very simple and the lock nut 23 is readily accessible.

Another important advantage of the improved appratus is that the extent of pivotal movement of the lever 14 in the first and second directions (only the movement in the first direction is important) can be changed without replacing any component parts of the step-down transmission. This renders it possible to reduce the initial and maintenance cost of the transmission as well as to reduce the periods of time which are needed to change the extent to which the knives 1 are advanced outwardly per unit of time (provided that the RPM of the holder 101 is constant).

A further important advantage of the improved apparatus is that the adjusting means 16 is installed in the transmission 3, i.e., that there is no need to provide discrete adjusting means for each shifting means 37. This, too, contributes to simplicity and lower cost of the apparatus.

It goes without saying that the apparatus can be equipped with other suitable means for rotating the crankshaft 8 of the input means 7 in response to rotation of the holder 101. The illustrated arrangement (stationary worm 2 and orbiting worm wheel 6) is especially satisfactory because it is simple, compact and can stand long periods of use.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Rotary cutting apparatus for use in a tobacco cutting machine adapted to compensate for knife wear, comprising at least one knife which is mounted on and is movable with respect to a rotary holder, a transmission mounted on said holder and having input means comprising a rotary crankshaft, means for rotating said crankshaft to response to rotation of said holder, output means including a rotary element, and motion transmitting means for intermittently moving said output means in response to movement of said input means, said motion transmitting means including a pivotable member, means for pivoting said member in first and second directions in response to rotation of said crankshaft and means for driving said rotary element in response to the pivoting of said member in said first direction; and displacing means for moving said knife in response to intermittent movements of said output means.

2. The apparatus of claim 1, wherein said transmission is a step-down transmission.

3. The apparatus of claim 1, wherein said driving means comprises a one-way clutch.

4. The apparatus of claim 1, further comprising adjusting means for varying the extent of pivotal movement of said member in said first and second directions in response to rotation of said crankshaft.

5. The apparatus of claim 4, wherein said adjusting means comprises means for varying the effective length of said pivotable member.

6. The apparatus of claim 4, wherein said member is pivotable about a predetermined axis and said adjusting means includes means for coupling said crankshaft with said member at any one of a plurality of selected distances from said axis.

7. The apparatus of claim 6, wherein said member has an elongated slot extending substantially radially of said axis and said motion transmitting means comprises a connector having a first end portion articulately connected with said crankshaft and a second end portion, said coupling means including means for attaching said second end portion to said member including a pin extending into and movable lengthwise of said slot and means for releasably locking said pin in a selected portion of said slot.

8. The apparatus of claim 1, wherein said rotary element is a gear and said driving means includes a freewheel arranged to rotate said gear in response to pivoting of said member in said first direction.

9. The apparatus of claim 8, wherein said holder carries a plurality of knives and said gear is coaxial with said holder, said displacing means including means for simultaneously moving all of said knives with reference to said holder in response to rotation of said gear.

10. The apparatus of claim 9, wherein said gear is a ring gear.

11. The apparatus of claim 1, wherein means for rotating said crankshaft in response to rotation of said holder, includes a stationary worm coaxial with said holder and a worm wheel rotatably mounted in said holder for orbital movement about and meshing with said worm.

12. The apparatus of claim 11, wherein said crankshaft is coaxial with and is driven by said worm wheel.

* * * * *